United States Patent [19]

Soltani et al.

[11] Patent Number: 5,074,000

[45] Date of Patent: Dec. 24, 1991

[54] APPARATUS FOR PERFORMING HEAD AND FOOT TRENDELENBURG THERAPY

[75] Inventors: Sohrab Soltani; Robert C. Novack; Timothy G. Clark, all of Charleston, S.C.

[73] Assignee: SSI Medical Services, Inc., Charleston, S.C.

[21] Appl. No.: 640,217

[22] Filed: Jan. 11, 1991

[51] Int. Cl.[5] ..... A61G 7/005; A61G 7/012; A61G 7/057

[52] U.S. Cl. ..... 5/62; 5/63; 5/453; 254/9 C; 269/323

[58] Field of Search ..... 5/62, 63, 64, 66–69, 5/60, 453, 449; 254/9 C, 122; 269/323

[56] References Cited

U.S. PATENT DOCUMENTS

| | | | |
|---|---|---|---|
| 2,009,156 | 7/1935 | Wyatt | 5/65 |
| 3,036,314 | 5/1962 | Wetzler | 5/63 |
| 3,222,693 | 12/1965 | Pruim et al. | 5/62 |
| 3,237,212 | 3/1966 | Hillenbrand et al. | 5/63 |
| 3,267,493 | 8/1966 | Pruim et al. | 5/63 |
| 3,373,453 | 3/1968 | Goodman | 5/63 |
| 3,428,973 | 2/1969 | Hargest et al. | 5/453 |
| 3,492,679 | 2/1970 | Drew | 5/68 |
| 3,611,452 | 10/1971 | Turko et al. | 5/62 |
| 3,722,010 | 3/1973 | Saternus | 5/66 |
| 4,025,972 | 5/1977 | Adams et al. | 5/63 |
| 4,483,029 | 11/1984 | Paul | 5/453 |
| 4,564,965 | 1/1986 | Goodwin | 5/453 |
| 4,574,785 | 3/1986 | Yamamoto | 5/453 |
| 4,599,755 | 7/1986 | Tominaga | 5/453 |
| 4,637,083 | 1/1987 | Goodwin | 5/453 |
| 4,914,760 | 4/1990 | Hargest et al. | 5/453 |
| 4,942,635 | 7/1990 | Hargest et al. | 5/453 |
| 4,967,431 | 11/1990 | Hargest et al. | 5/453 |

*Primary Examiner*—Alexander Grosz

*Attorney, Agent, or Firm*—Dority & Manning

[57] ABSTRACT

An apparatus for performing Trendelenburg therapy and reverse Trendelenburg therapy includes an intermediate frame carried above a base frame by an inner cross-riser pivotally connected to an outer cross-riser. One end of the outer cross-riser to pivotally connected to the base frame, and the opposite end of the outer cross-riser is rotatably and translatably connected to the intermediate frame via a cam and cam follower arrangement in which the cam follower rides on a wear plate. One end of the inner cross-riser is pivotally connected to the intermediate frame, and the opposite end of the inner cross-riser is both rotatably and translatably connected to the base frame via a cam and cam follower arrangement in which the follower rolls against a lower wear plate. A pivotable Trendelenburg linkage is carried on the end of the inner cross-riser connected to the intermediate frame, and a pivotable reverse Trendelenburg linkage is carried on the end of the outer cross-riser rotatably and translatably connected to the intermediate frame. Dual acting hydraulic cylinders power the raising and lowering of the intermediate frame by effecting a scissor movement between the inner cross-riser and outer cross-riser. Single acting hydraulic cylinders power the pivoting movement of the Trendelenburg linkage. Similarly, single acting hydraulic cylinders power the pivoting movement of the reverse Trendelenburg linkage.

20 Claims, 7 Drawing Sheets

APPARATUS FOR PERFORMING HEAD AND FOOT TRENDELENBURG THERAPY

BACKGROUND OF THE INVENTION

The present invention relates to patient support systems capable of performing Trendelenburg therapy and more particularly to an apparatus for performing Trendelenburg therapy in a patient support system which supports at least a portion of the patient's body in an air fluidized mass of material.

Trendelenburg therapy is applied to patients suffering from any of a number of conditions. Trendelenburg therapy involves the elevation of either the patient's head or feet by about 7° from the horizontal. Elevation of the feet of a patient to a position about 7° above the horizontal plane while simultaneously positioning the patient's head at about the same angle below the horizontal plane is known as head Trendelenburg therapy or as simply Trendelenburg therapy. Similarly, elevation of the patient's head to a position about 7° above the horizontal plane while simultaneously positioning the patient's feet at about the same angle below the horizontal plane is known as foot Trendelenburg therapy or as Reverse Trendelenburg therapy.

Most conventional hospital beds provide apparatus for elevating the head and feet of a patient to perform head and foot Trendelenburg therapy. In some beds, this apparatus constitutes a hand manipulated crank or ratchet. In other beds it is a scissors jack arrangement, while in still others it resembles a screw jack arrangement. In yet other embodiments, the apparatus includes gas springs which are released manually to place the head or foot section of the bed into the 7° uneven elevated position.

In an air fluidized patient support system such as disclosed in U.S. Pat. Nos. 3,428,973 to Hargest et al, 4,483,029 to Paul, 4,564,965 to Goodwin, 4,599,755 to Tominaga, and 4,637,083 to Goodwin, which are hereby incorporated herein by reference, the weight of the fluidizable mass of material renders uneven elevation of the head and foot of the bed impracticable, if not impossible.

OBJECTS AND SUMMARY OF THE INVENTION

It is a principal object of the present invention to provide an apparatus for performing head and foot Trendelenburg therapy in a patient support system which supports at least a portion of the patient's body in an air fluidized mass of material.

It is a further principal object of the present invention to provide an apparatus for performing head and foot Trendelenburg therapy in a patient support system which supports at least a portion of the patient's body in an air fluidized mass of material, wherein the apparatus also can raise and lower the patient support surface formed by the mass of fluidizable material.

Another principal object of the present invention is to provide an apparatus for performing head and foot Trendelenburg Therapy in a dual mode patient support system.

It is yet another principal object of the present invention to provide an apparatus for performing head and foot Trendelenburg therapy in a dual mode patient support system which supports at least a portion of the patient's body in an air fluidized mass of material, wherein the apparatus also can raise and lower the patient support surface formed by the mass of fluidizable material.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

In accordance with the present invention, an apparatus is provided for performing Trendelenburg therapy and reverse Trendelenburg therapy as well as vertical elevation of a patient support system which supports at least a portion of the patient's body in an air fluidized mass of material. As embodied herein, the apparatus of the present invention can include a base frame, an intermediate frame, means for powering the raising and lowering of the intermediate frame with respect to the base frame, an inner cross-riser, an outer cross-riser, a Trendelenburg linkage, means for activating the Trendelenburg linkage to orient the intermediate frame to perform Trendelenburg therapy, a reverse Trendelenburg linkage, and means for activating the reverse Trendelenburg linkage to orient the intermediate frame to perform reverse Trendelenburg therapy.

The base frame supports the rest of the patient support system above the floor and typically includes a plurality of casters. One embodiment of the base frame defines a pair of elongated tubular outside rails disposed side-by-side and parallel to one another. The outside rails are connected at one of their ends by a forward end rail and at the other of their ends by a rear end rail. The rear end rail can be provided with a pair of separated bracket plates, and the forward end rail can be provided with a pair of mounting bracket plates. In some embodiments, an intermediate cross-rail can be provided with bracket plates. Each of the bracket plates is configured to receive a pivoting member and to provide a pivoting connection with such pivoting member.

A cam is defined along the interior surface of each outside rail of the base frame. Each cam is formed by a lower wear plate and an upper plate connected to the lower wear plate by a pair of oppositely disposed end plates. Such cam defines a confined space for receiving a cam follower rotatably riding atop the lower wear plate. The two cams are disposed closer to one of the opposite ends of the outside rails.

The intermediate frame functions as the intermediary between the fluidized mass of material which supports the occupant of the fluidized support system and the activation system which performs Trendelenburg and reverse Trendelenburg therapies and changes the elevation level of the occupant support surface of the fluidized support system. The intermediate frame carries the fluidized mass of material, and one embodiment of the intermediate frame is defined by a pair of oppositely disposed side rails. The side rails desirably are disposed parallel to one another and are connected by cross supports such as a front end support, a center support, and a rear end support. A cam is disposed along a portion of the inner side surface of each of the side rails of the intermediate frame. Each cam is rectangular and includes an upper wear plate, a lower wear plate, and two opposed end plates disposed between the upper wear plate and the lower wear plate. Thus, each cam defines a rectangular volume to define and limit the translational movement of a cam follower which rides along the upper wear plate between the two opposed end plates.

The inner cross-riser helps support the intermediate frame above the base frame and connects the base frame to the intermediate frame. For example, one embodiment of the inner cross-riser is desirably formed by a pair of elongated lower side members, a pair of elongated upper side members, a sliding end bar, a pivoting end bar, and an intermediate scissor bar. The intermediate scissor bar is disposed transversely between the lower side members and the upper side members. The sliding end bar is connected to the opposite ends of the lower side members and has rotatable free ends that permit the sliding end bar to be translated with respect to the base frame. In one embodiment of the sliding end bar, a circularly cylindrical cam follower is rotatably mounted at each oppositely disposed free end of the sliding end bar. Each cam follower is received within the base frame cam and rides on the lower wear plate. A mounting bracket is attached to each outer surface of each of the upper side members and disposed in the vicinity of the intermediate scissor bar. The pivoting end bar is connected to the other ends of the upper side members and is disposed parallel to the intermediate scissor bar.

The outer cross-riser cooperates with the inner cross-riser to help support the base frame above the intermediate frame and also connects the base frame to the intermediate frame. For example, one embodiment of the outer cross-riser includes a pair of elongated side rails and a top bar extending transversely between the side rails. The free ends of each side rail diverge slightly outwardly from one another as they extend away from the top bar. The intermediate scissor bar of the inner cross-riser is transversely disposed intermediate along the lengths of the side rails of the outer cross-riser and pivotally connected to same. The free diverging ends of the side rails of the outer cross-riser are each pivotally connected to one of the pair of bracket plates connected to the rear end rail of the base frame.

The Trendelenburg linkage functions to orient the patient support surface for performing Trendelenburg therapy. One embodiment of the Trendelenburg linkage can be formed so as to define a pair of Trendelenburg members disposed at opposite ends of a Trendelenburg cross bar. Each Trendelenburg member can be formed as a flat steel plate having an essentially L-shaped form. Each Trendelenburg member defines a toe-connecting portion, a heel-connecting portion, and a calf-connecting portion. Each of these portions is disposed at a vertex of a triangular configuration. The heel-connecting portion is defined in the vicinity of where the shorter leg of the L-shaped plate joins with the longer leg of the L-shaped plate. The toe-connecting portion is defined in the vicinity of the free end of the shorter leg of the L-shaped plate. The calf-connecting portion is defined in the vicinity of the free end of the longer leg of the L-shaped plate. Moreover, an opening is defined near the end of each calf-connecting portion. The Trendelenburg cross bar extends transversely through the openings provided through the calf-connecting portions and is fixed nonrotatably thereto.

A similarly configured reverse Trendelenburg linkage is provided in order to place the patient support surface into an orientation that effects reverse Trendelenburg therapy. The reverse Trendelenburg linkage can be formed so as to define a pair of reverse Trendelenburg members disposed at opposite ends of a reverse Trendelenburg cross bar. Each reverse Trendelenburg member can be formed as a flat steel plate having an essentially L-shaped form. Each reverse Trendelenburg member defines a toe-connecting portion, a heel-connecting portion, and a calf-connecting portion. Each of these portions is disposed at a vertex of a triangular configuration. The heel-connecting portion is defined in the vicinity of where the shorter leg joins with the longer leg of the L-shaped plate. The toe-connecting portion is defined in the vicinity of the free end of the shorter leg of the L-shaped plate. The calf-connecting portion is defined in the vicinity of the free end of the longer leg of the L-shaped plate. An opening is defined near the end of each calf-connecting portion. Each free end of the reverse Trendelenburg cross bar is attached to one of the two reverse Trendelenburg plates, thereby connecting the two reverse Trendelenburg plates. Each free end of the reverse Trendelenburg bar is disposed to extend transversely from a location between the heel-connecting portion and the calf-connecting portion of one of the two reverse Trendelenburg plate members.

Each heel connecting portion of each Trendelenburg plate member is pivotally connected to one of the free ends of the pivoting end bar of the inner cross-riser. Similarly, each heel-connecting portion of each reverse Trendelenburg plate member is pivotally connected to one of the free ends of the top bar of the outer cross-riser.

A rotatable cam follower is mounted rotatably in each opening of each calf-connecting portion of each reverse Trendelenburg plate member. Each such cam follower is circularly cylindrical. Each reverse Trendelenburg cam follower is received within one of the cams attached to the inner surface of one of the side rails of the intermediate frame and rides on the upper wear plate of such cam.

Means are provided for powering the raising and lowering of the intermediate frame with respect to the base frame. The powering means can include means for powering the translation of one of the cross-risers (inner or outer) with respect to one of the frames (base frame or intermediate frame) and the other of the cross-risers with respect to the other of the frames. For example, one embodiment of the cross-riser translating means can include at least one main hydraulic cylinder and preferably a second main hydraulic cylinder. Each of the main hydraulic cylinders is a dual acting hydraulic cylinder, and thus has hydraulic fluid on both sides of the piston. However, only the hydraulic fluid on one side of the piston is connected to a pressurized hydraulic fluid source. Each main hydraulic cylinder has a first end pivotally connected to the base frame by the mounting bracket plate. The second end of each main hydraulic cylinder is disposed opposite the first end of each main hydraulic cylinder and is pivotally connected to the lower end of the inner cross-riser, which is the end of the inner cross-riser connected to the sliding end bar. The sliding end bar of the inner cross-riser has a mounting bracket for pivotally attaching to one of the main hydraulic cylinder's ends.

The end of the inner cross-riser connected to the sliding end bar is both rotatable and translatable with respect to the base frame as each main hydraulic cylinder extends or retracts its respective piston rod. Moreover, the ends of the outer cross-risers' side rails pivotally connected to the reverse Trendelenburg linkage, are simultaneously rotatable and translatable with respect to the intermediate frame as each main hydraulic cylinder expands or retracts its piston rod. The extension or retraction of each piston rod of each main hydraulic cylinder causes simultaneous rotation and translation of one of the respective ends of each of the cross-risers, and the intermediate frame moves vertically toward or away from the base frame. During this vertical movement, the intermediate frame maintains a level orientation as the reverse Trendelenburg linkage rotates about the cam follower and the Trendelenburg linkage pivots about the free ends of the Trendelenburg cross bar, which is pivotally connected to the intermediate frame.

Means are provided for activating the Trendelenburg linkage to orient the intermediate frame to perform Trendelenburg therapy. The Trendelenburg activating means can include means for pivoting the Trendelenburg linkage about each respective heel-connecting portion. For example, one embodiment of the pivoting means for the Trendelenburg linkage desirably includes at least one Trendelenburg hydraulic cylinder. However, it is desirable to provide a pair of Trendelenburg hydraulic cylinders in order to maintain symmetry of movement. Each Trendelenburg hydraulic cylinder has a first end pivotally connected to the inner cross-riser, desirably at the mounting bracket plate of the inner cross-riser. The opposite end of each Trendelenburg hydraulic cylinder is pivotally connected to a respective Trendelenburg linkage toe-connecting portion.

Means also are provided for activating the reverse Trendelenburg linkage to orient the intermediate frame to perform reverse Trendelenburg therapy. The reverse Trendelenburg activating means can include means for pivoting the reverse Trendelenburg linkage about each respective heel-connecting portion. For example, one embodiment of the means for pivoting the reverse Trendelenburg linkage can include at least one reverse Trendelenburg hydraulic cylinder, but preferably a pair of reverse Trendelenburg hydraulic cylinders are provided. Each reverse Trendelenburg hydraulic cylinder has a first end pivotally connected to a mounting bracket attached to the side rail of the outer cross-riser. The opposite end of each reverse Trendelenburg hydraulic cylinder is pivotally connected to a respective reverse Trendelenburg linkage toe-connecting portion.

Each of the Trendelenburg hydraulic cylinders and each of the reverse Trendelenburg hydraulic cylinders need only be single action hydraulic cylinders.

The accompanying drawings, which are incorporated in and constitute a part of this specification, illustrate embodiments of the invention and, together with the description, serve to explain the principles of the invention.

DETAILED DESCRIPTION OF THE PREFERRED EMBODIMENTS

Reference now will be made in detail to the present preferred embodiments of the present invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover the modifications and variations of this invention provided they come within the scope of the appended claims and their equivalents.

In accordance with the present invention, an apparatus is provided for performing Trendelenburg Therapy and Reverse Trendelenburg Therapy in a patient support system which supports at least a portion of the patient's body in an air fluidized mass of material. An example of the type of patient support system for which the present invention is especially suited is designated generally in FIG. 1 by the numeral 20 and is disclosed in U.S. Pat. No. 4,942,635 to Hargest et al (hereafter referenced by the shorthand notation HARGEST et al), the disclosure of which patent being hereby incorporated into this patent application by this reference. Other examples of fluidized patient support systems for which the present invention could be suitable include those described in U.S. Pat. Nos. 3,428,973 to Hargest et al, 4,483,029 to Paul, 4,564,965 to Goodwin, 4,599,755 to Tominaga, and 4,637,083 to Hargest et al, 4,914,760 to Hargest et al and 4,967,431 to Hargest et al, the disclosures of which patents being hereby incorporated into this patent application by this reference.

Figure 1:
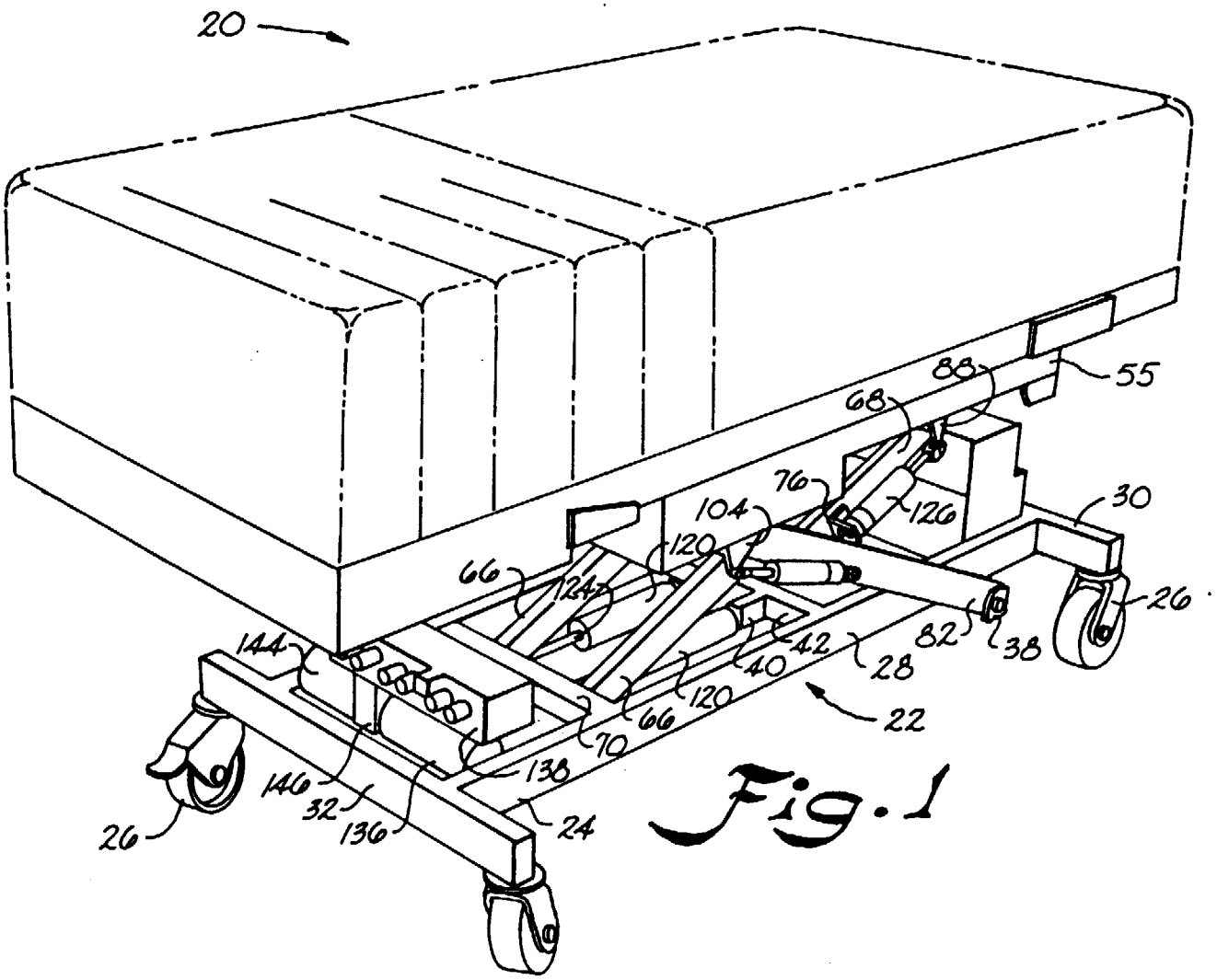
FIG. 1 illustrates an elevated perspective view of a preferred embodiment of the present invention in a configuration with a dual mode patient support system.

A preferred embodiment of the apparatus of the present invention for performing head and foot Trendelenburg Therapy is shown in FIG. 1 and is designated generally by the numeral 22. Another preferred embodiment of the apparatus of the present invention that is desirably employed with one of the HARGEST et al type patient support systems is the embodiment illustrated in FIGS. 5 and 8 for example. As embodied herein and shown in FIGS. 1-5 and 8 for example, the apparatus of the present invention includes a base frame 24. The base frame supports the rest of the patient support system above the floor and typically includes a plurality of casters 26. Since a fluidized patient support system typically weighs more than 1,000 pounds and closer to a ton, base frame 24 is typically constructed of strong, rigid metallic extrusions which are welded or bolted together in an appropriate elongated configuration. Base frame 24 desirably is fabricated from eleven gauge steel (one eighth inch thick).

Figure 5:
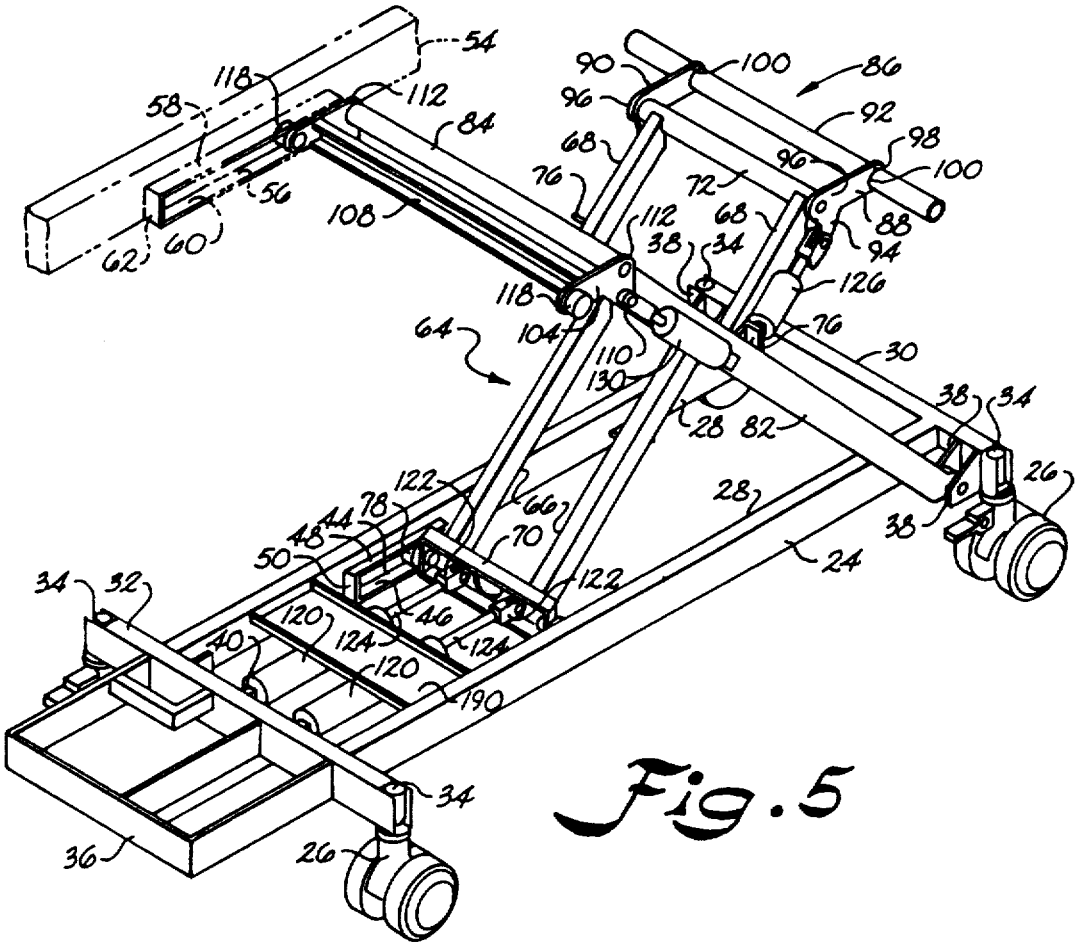
FIG. 5 is a schematic elevated perspective view of components of a preferred embodiment of the present invention including certain components shown in phantom and partially broken for clarity of presentation of other components.

As embodied herein and shown in FIG. 5 for example, base frame 24 defines a pair of elongated tubular outside rails 28 disposed side-by-side and parallel to one another. The outside rails are connected at their rear ends by an end rail 30, which is formed as a similarly configured elongated tubular extrusion. A similarly configured forward end rail 32 is disposed to connect outside rails 28 near their opposite forward ends. Each of the end rails 30, 32 and outside rails 28 can be formed as rectangular tubular steel members welded to one another where they meet. The end rails are longer than the separation between the outside rails 28 and so extend beyond the outside surfaces of outside rails 28. Near each of the free ends of end rails 30, 32, vertically extending holes 34 are defined to receive the center shaft of each caster 26. The separation between the rear end rail 30 and the forward end rail 32 depends on the weight requirements of the base frame 24 and the dimensions, materials, and configuration of the base frame and the rails forming the base frame. Moreover, in some embodiments of the base frame, it becomes desirable to provide an extension of base frame beyond one or both of the end rails. As shown in FIG. 5 for the HARGEST et al system for example, an extension 36 is formed of plate metal steel members welded to forward end rail 32 and designed to provide a carriage for various auxiliary components of the patient support system.

Figure 8:
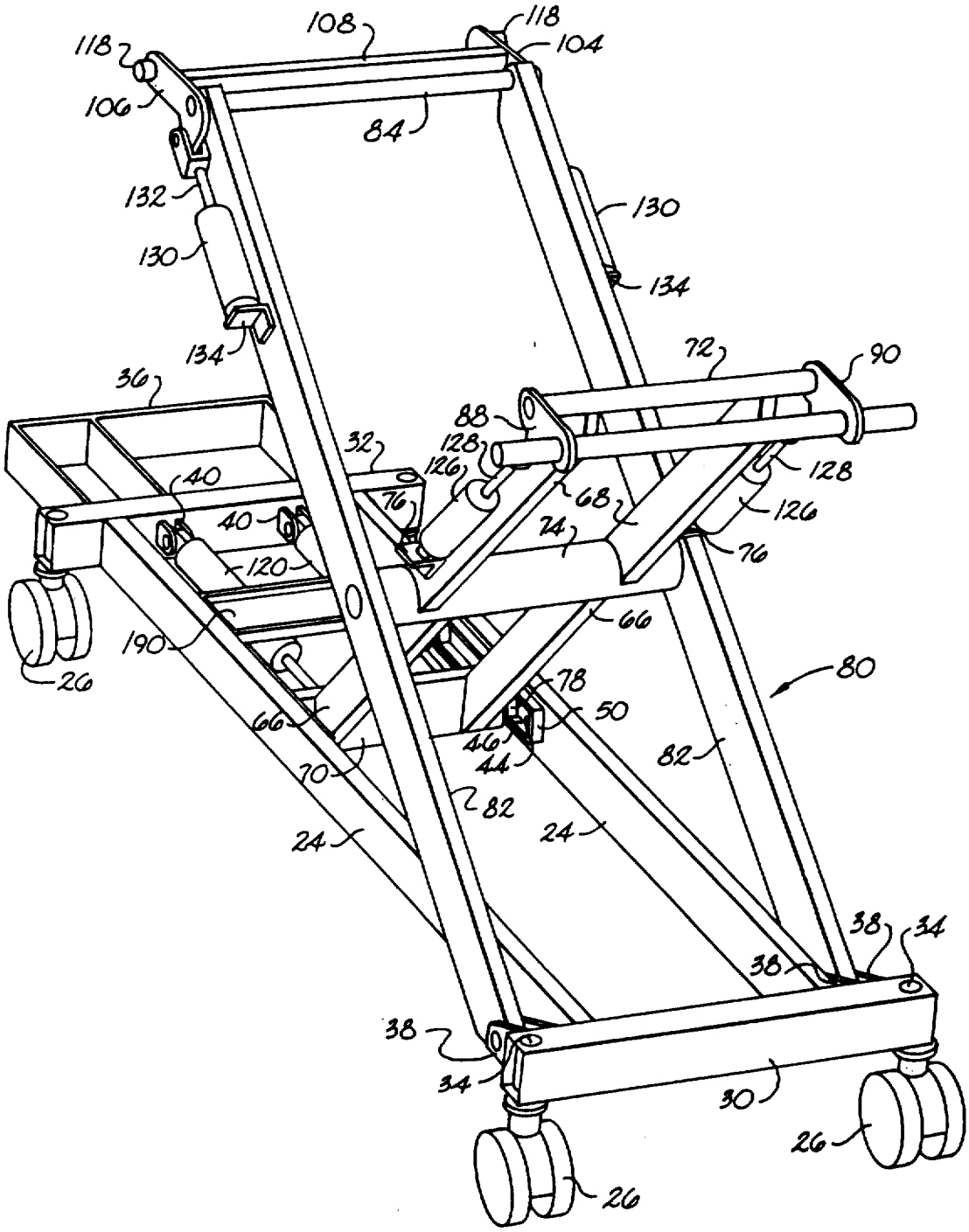
FIG. 8 a schematic elevated perspective view of components of a preferred embodiment of the present invention.

The base frame provides structures for pivoting connection of other elements of the apparatus of the present invention. As shown in FIG. 5 for example, rear end rail 30 is provided with a pair of separated bracket plates near each of its free ends and facing toward forward end rail 32. Similarly, as shown in FIG. 8 for example, the side of forward end rail 32 facing toward rear end rail 30 also is provided with a pair of mounting bracket plates 40 disposed at the intermediate portion of the forward end rail 32. In the embodiment shown in FIGS. 1 and 2-4 for example, bracket plate 38 is shown in phantom (dashed line), and bracket plate 40 is shown attached to an intermediate cross-rail 42, which extends perpendicularly between outside rails 28. Each of these bracket plates 38, 40 is configured to receive a pivoting member and to provide a pivoting connection with such pivoting member. The pivoting members to be connected to these bracket plates are described hereafter.

As embodied herein and shown in FIGS. 2-5 for example, a cam 44 is defined along the interior surface of each outside rail 28 of the base frame 24. Each cam is formed by a lower wear plate 46 and an upper plate 48 connected to the lower wear plate by a pair of oppositely disposed end plates 50. Each cam 44 is symmetrically disposed along the inner surface of an outside rail 28 of the base frame and directly across from the cam on the oppositely disposed outside rail 28. Moreover, the two cams are disposed closer to one of the opposite ends of the outside rails 28. As shown in FIGS. 2-5 for example, each cam 44 is disposed closer to forward end rail 32 than to rear end rail 30.

In further accordance with the present invention, an intermediate frame is provided for carrying the fluidized mass of material. The intermediate frame functions as the intermediary between the fluidized mass of material which supports the occupant of the fluidized support system and the activation system which performs Trendelenburg and Reverse Trendelenburg therapies as well as changing the elevation level of the occupant support surface of the fluidized support system. As shown in FIG. 1 for example, a tank 55 of fluidized support system 20 is provided with an open top and a diffuser board forming a false bottom to carry the mass of fluidizable material and permit fluidization of this material. As embodied herein and shown schematically in FIGS. 2-4 for example, an intermediate frame 52 defines an elongated tubular steel structure. A portion of a side rail 54 of intermediate frame 52 is shown in phantom in FIG. 5 for example. The remaining configuration of intermediate frame 52 depends in large measure upon the requirements of the support system involved. For example, intermediate frame 52 is disposed to carry structure such as tank 55 for example and so carry the mass of fluidizable material. In addition, the intermediate frame can be provided with various auxiliary fastening and/or support structures which enable the intermediate frame to carry tank 55. Since intermediate frame 52 carries the fluidizable mass of material, frame 52 must be sufficiently sturdy and rigid to perform this function. Accordingly, intermediate frame 52 desirably is formed of a metal such as eleven gauge steel (one eighth inch thick).

As embodied herein and shown in FIG. 5 for example, intermediate frame 52 would include a pair of oppositely disposed side rails 54 such as side rail 54 partially illustrated in dashed line. Parallel to side rail 54 would be the second side rail in the pair defining the intermediate frame 52, but such second side rail is not shown in FIG. 5 in order to avoid unduly complicating the drawing. The side rails would be connected by cross supports such as a front end support (not shown) disposed near the front end of the side rails, a rear end support (not shown) disposed near the back end of the side rails, and a center support (not shown) disposed between the front end support and the rear end support. The side rails would be disposed parallel to one another and the supports would extend transversely relative to the direction of elongation of the side rails. For example, each of the side rails in a dual mode patient support system such as disclosed in HARGEST et al can be defined by rectangular hollow steel tubing having walls measuring one-eighth inch thick and one inch wide by two inches high. Each of the end supports and the center support can be formed by angle 11 gauge HRS P & O solid steel bars measuring one and seven-eighths inch thick by thirty one and three-quarter inches long. One of the end supports measures two and one-quarter inches wide, the other end support measures four inches wide, and the center support measures two inches wide.

As shown in FIGS. 2-5 for example, a cam 56 is disposed along a portion of the inner side surface (the surface that faces toward the opposite side rail) of each side rail 54 of intermediate frame 52. Each intermediate frame cam 56 is rectangular and includes an upper wear plate 58, a lower plate 60, and two opposed end plates 62 disposed between upper wear plate 58 and lower plate 60. Each cam 56 is symmetrically disposed along the inner side surface of a side rail 54 of the intermediate frame and directly across from the cam on the oppositely disposed side rail 54.

Figure 2:
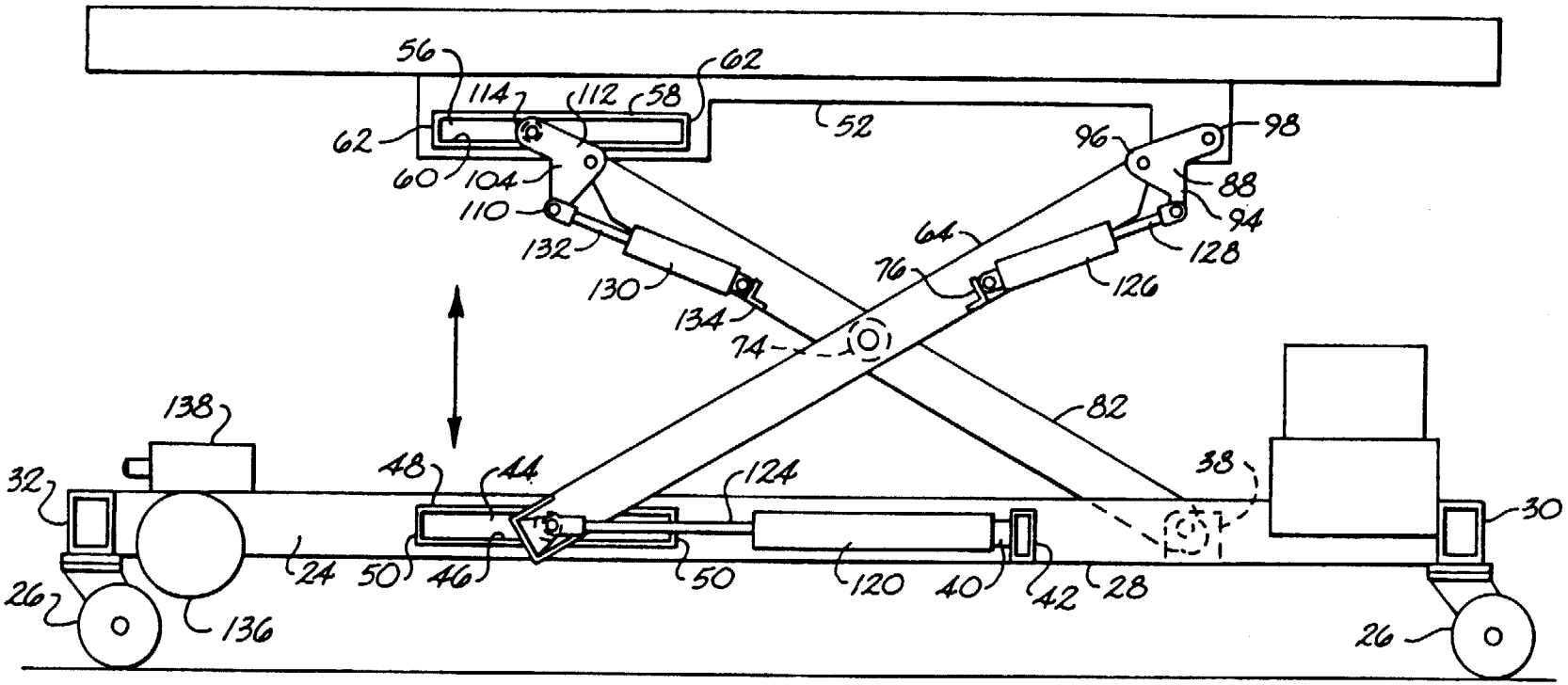
FIG. 2 is a schematic representation of a side plan view of an embodiment of components of the present invention illustrating vertical elevation of the patient support surface while maintaining the patient support surface in a level condition.
Figure 3:
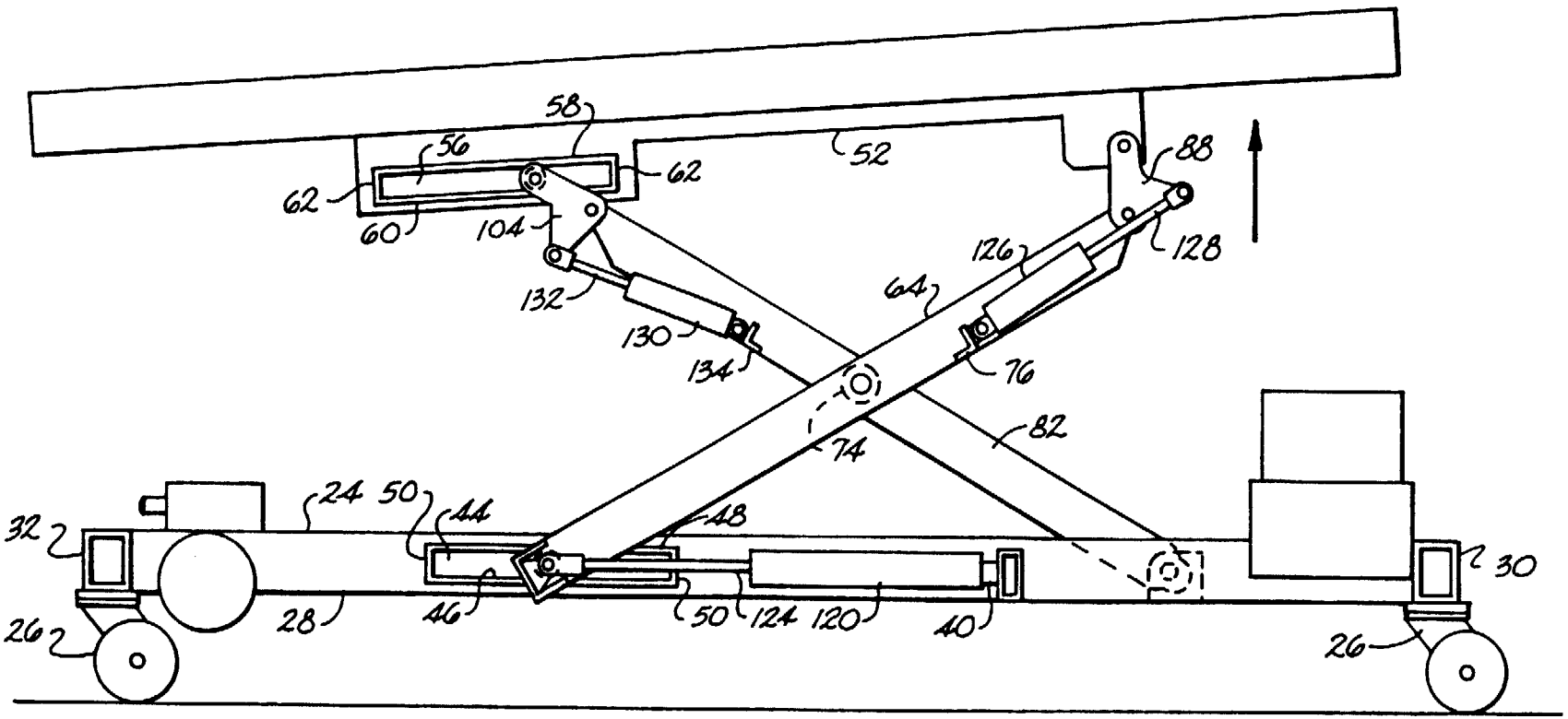
FIG. 3 illustrates a schematic representation of a side plan view of components of an embodiment of the present invention configured in the Reverse Trendelenburg orientation.
Figure 4:
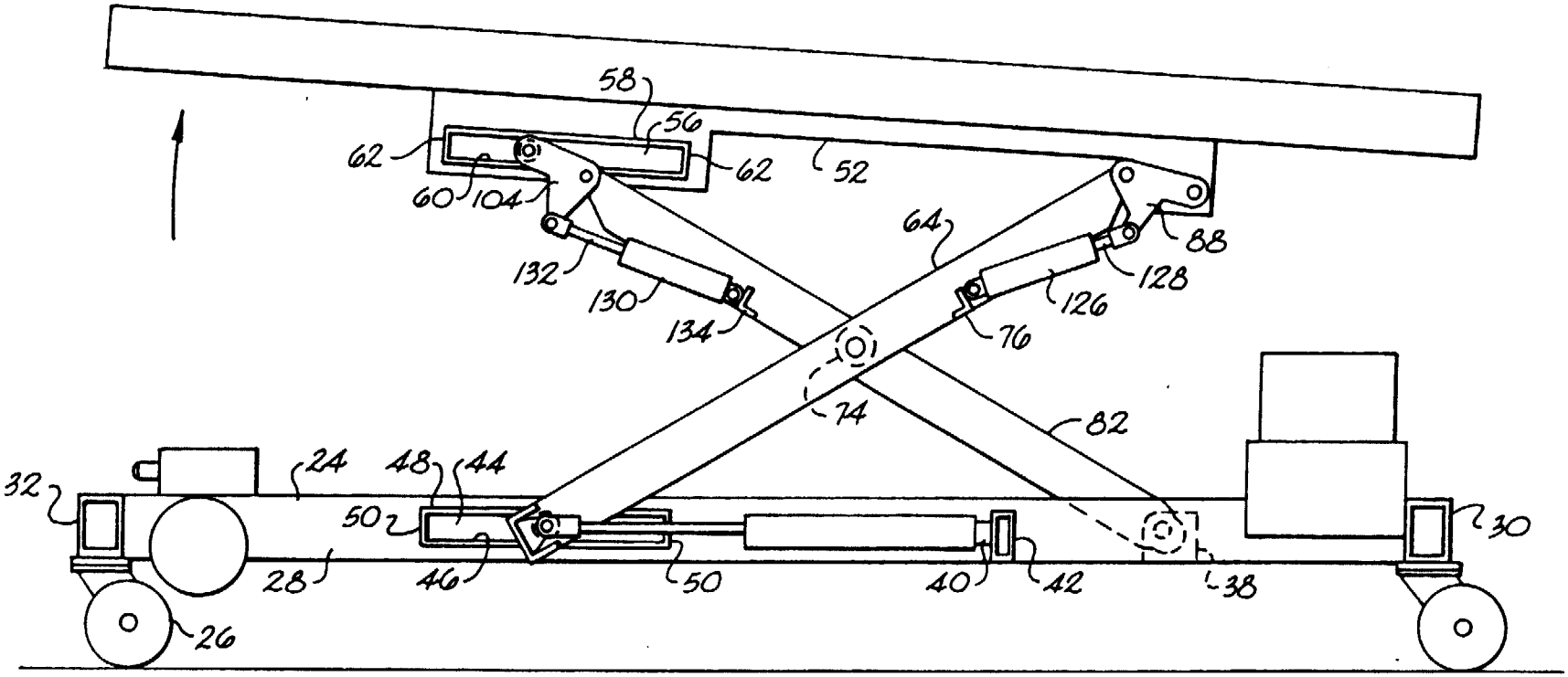
FIG. 4 illustrates a schematic representation of a side p view of components of an embodiment of the present invention configured in the Trendelenburg orientation.

In yet further accordance with the present invention, an elongated inner cross-riser is provided. As embodied herein and shown in FIG. 5 for example, an inner cross-riser 64 is formed by a pair of elongated lower side members 66, a pair of elongated upper side members 68, a sliding end bar 70, and a pivoting end bar 72. Lower side members 66 are spaced apart less than upper side members 68. FIGS. 2-4 also depict a schematic representation of inner cross-riser 64 and show an intermediate scissor bar 74 in phantom. As shown in FIGS. 2-4 and 8 for example, an intermediate scissor bar 74 is disposed transversely between lower side members 66 and upper side members 68. One of each of the ends of lower side members 66 are welded to one side of intermediate scissor bar 74, while one of the ends of upper side members 68 are welded to the opposite side of intermediate scissor bar 74 and in line with lower side members 66. As shown in FIGS. 1 and 5 for example, a sliding end bar 70 is welded to the opposite ends of lower side members 66. As shown in FIGS. 1 and 5 for example, a mounting bracket 76 is attached to each outer surface of each upper side member 68 in the vicinity of intermediate scissor bar 74. As shown in FIG. 5 for example, the opposite end of upper side members 68 is welded to a pivoting end bar 72, which is disposed parallel to intermediate scissor bar 74.

As noted above and shown in FIG. 5 for example, base frame 24 defines an elongated cam 44 on the interior facing surface of each opposite outside rail 28. Each cam 44 defines a lower wear plate 46. A circularly cylindrical cam follower 78 is rotatably mounted at each oppositely disposed free end of sliding end bar 70 of inner cross riser 64. Each cam follower 78 is received within each base frame cam 44 and rides on each lower wear plate 46. Thus, inner cross-riser 64 is disposed both rotatably with respect to base frame 24 and can move translationally with respect to base frame 24. In this way, inner cross-riser 64 can move from a raised configuration such as shown in FIGS. 2 and 5 for example to a reduced elevation or compressed configuration such as shown in FIG. 1 for example.

In still further accordance with the present invention, an outer cross-riser is provided. As embodied herein and shown in FIG. 8 for example, an outer cross-riser 80 includes a pair of elongated side rails 82. A top bar 84 extends transversely between the side rails and is connected, as by being welded for example, to the first free ends of each side rail 82. In one preferred embodiment of the present invention designed for the HARGEST et al patient support system for example, the second free ends of each side rail 82 diverge outwardly (in the direction toward the free ends of top bar 84) as the side rails extend away from top bar 84. This divergence angle is only a small angle of about two degrees and twelve minutes.

Intermediate scissor bar 74 of inner cross-riser 64 is transversely disposed intermediate along the lengths of side rails 82 of outer cross-riser 80 and is pivotally connected to outer cross-riser 80. Accordingly, inner cross-riser 64 and outer cross-riser 80 pivot with respect to one another in a scissor-like fashion. As shown in FIGS. 1-5 for example, each of the second ends of the side rails 82 of outer cross-riser 80 is pivotally connected to a pair of bracket plates 38 connected near (FIGS. 1-4) or to (FIG. 5) rear end rail 30 of base frame 24.

Because intermediate frame 52 is carried by inner cross-riser 64 and outer cross-riser 80, they desirably are formed of a metal such as eleven gauge steel (one eighth inch thick).

In yet further accordance with the present invention, a Trendelenburg linkage is provided. As explained hereafter, activation of the Trendelenburg linkage is used to place the patient support surface into an orientation that effects Trendelenburg Therapy. In the embodiment shown in FIGS. 2-5 for example, a Trendelenburg linkage (generally designated in FIG. 5 by the numeral 86) can define a first Trendelenburg member 88, a second Trendelenburg member 90, and a Trendelenburg cross bar 92. Each Trendelenburg member 88, 90 is formed as a flat, eleven gauge steel plate member configured with what is essentially an L-shaped form. As shown schematically in FIG. 2 for example, each Trendelenburg member defines a toe-connecting portion 94, a heel-connecting portion 96, and a calf-connecting portion 98. Thus, an imaginary straight line drawn to connect the Trendelenburg member toe-connecting portion and the Trendelenburg member heel-connecting portion is disposed at an angle from where an imaginary straight line drawn to connect the Trendelenburg member calf-connecting portion and the Trendelenburg member heel-connecting portion is disposed. The heel connecting portion is defined in the vicinity of where the shorter leg joins with the longer leg of L-shaped plate 88, 90. The toe connecting portion is defined in the vicinity of the free end of the shorter leg of L-shaped plate 88, 90. The calf-connecting portion is defined in the vicinity of the free end of the longer leg of L-shaped plate 88, 90, and as shown in FIG. 5 for example, an opening 100 is defined near the end of each calf-connecting portion 98. Trendelenburg cross bar 92 extends transversely through openings 100 provided through the calf-connecting portions and is welded to the calf-connecting portions, thereby connecting the two Trendelenburg plates 88, 90.

Figure 6:
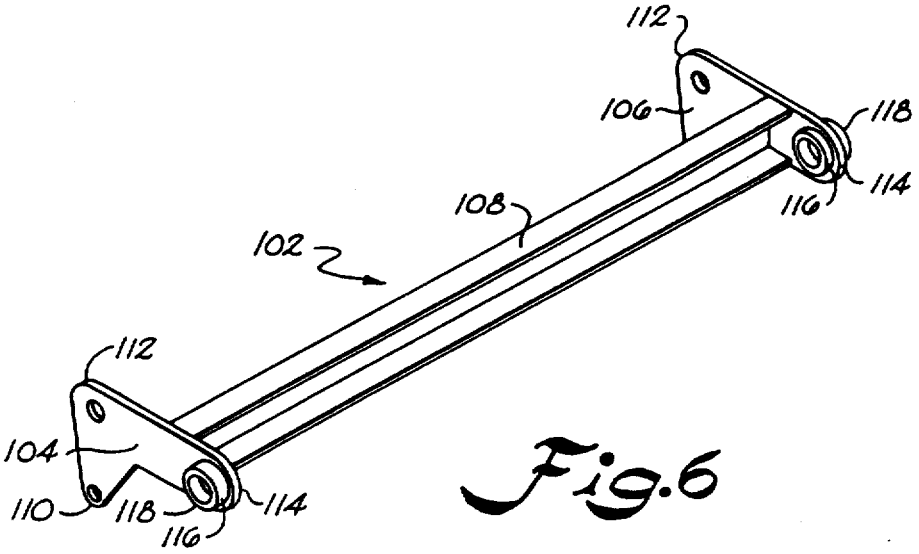
FIG. 6 illustrates an elevated perspective view of a component of an embodiment of the present invention.

In yet further accordance with the present invention, a reverse Trendelenburg linkage is provided. As explained hereafter, activation of the reverse Trendelenburg linkage is used to place the patient support surface into an orientation that effects Reverse Trendelenburg Therapy. In the embodiment shown in FIGS. 2-6 for example, a reverse Trendelenburg linkage (generally designated in FIG. 6 by the numeral 102) can define a first reverse Trendelenburg member 104, a second reverse Trendelenburg member 106, and a reverse Trendelenburg cross bar 108. Each reverse Trendelenburg member 104, 106 is formed as a flat, eleven gauge steel plate member configured with what is essentially an L-shaped form. As shown in FIG. 6 for example, each reverse Trendelenburg member 104, 106 defines a toe-connecting portion 110, a heel-connecting portion 112, and a calf-connecting portion 114. Thus, an imaginary straight line drawn to connect the reverse Trendelenburg member toe-connecting portion and the reverse Trendelenburg member heel-connecting portion is disposed at an angle from where an imaginary straight line drawn to connect the reverse Trendelenburg member calf-connecting portion and the reverse Trendelenburg member heel-connecting portion is disposed. The heel connecting portion is defined in the vicinity of where the shorter leg joins with the longer leg of L-shaped plate 104, 106. The toe connecting portion is defined in the vicinity of the free end of the shorter leg of L-shaped plate 104, 106. The calf-connecting portion is defined in the vicinity of the free end of the longer leg of L-shaped plate 104, 106, and an opening 116 is defined near the end of each calf-connecting portion 114. Each free end of reverse Trendelenburg cross bar 108 can be welded to one of the two reverse Trendelenburg plates 104, 106, thereby connecting the two reverse Trendelenburg plates. Each free end of reverse Trendelenburg bar 108 is disposed to extend transversely from a location between the heel-connecting portion and the calf-connecting portion of one of the two reverse Trendelenburg plate members.

As shown in FIG. 5 for example, each heel-connecting portion 96 of each Trendelenburg plate member 88, 90 is pivotally connected to one of the free ends of pivoting end bar 72 of inner cross-riser 64. Similarly, each heel-connecting portion 112 of each reverse Trendelenburg plate member 104, 106 is pivotally connected to one of the free ends of top bar 84 of outer cross-riser 80.

As shown in FIGS. 5 and 6 for example, a rotatable cam follower 118 is mounted in each opening 116 of each calf connecting portion 114 of each reverse Trendelenburg plate member 104, 106. Each cam follower 118 is circularly cylindrical. As shown in FIG. 5 for example, each reverse Trendelenburg cam follower 118 is received within one of the cams 56 attached to the inner surface of the one of the side rails 54 of intermediate frame 52 and rides on the upper wear plate 58 of such cam 56. Thus, outer cross-riser 80 is disposed both rotatably with respect to intermediate frame 52 and can move translationally with respect to intermediate frame 52. In this way, outer cross-riser 80 can move from an elevated configuration such as shown in FIGS. 2 and 5 for example to a reduced elevation or compressed configuration such as shown in FIG. 1 for example.

In yet further accordance with the apparatus of the present invention, means are provided for translating one of the cross-risers (inner or outer) with respect to one of the frames (base or intermediate) and the other of the cross-risers with respect to the other of the frames. As embodied herein and shown in FIGS. 1-5 for example, the cross-riser translating means includes at least one main hydraulic cylinder 120, and preferably a second main hydraulic cylinder 120 is provided. Each main hydraulic cylinder 120 has a first end pivotally connected to base frame 24 via a mounting bracket plate 40. Each main hydraulic cylinder 120 has a second end disposed opposite main hydraulic cylinder first end and pivotally connected to the lower end of inner cross-riser 64, which is the end of the inner cross-riser 64 connected to sliding end bar 70. As shown in FIG. 5 for example, sliding end bar 70 of inner cross-riser 64 has a mounting bracket 122 for pivotably attaching to each main hydraulic cylinder's second end, which in this embodiment happens to be the free end of the piston rod 124. Moreover, outer cross-riser 80 and inner cross-riser 64 are pivotally connected to one another between their first and second ends via intermediate scissor bar 74 of inner cross-riser 64.

As shown in FIGS. 2 and 5 for example, the end of inner cross-riser 64 connected to sliding end bar 70 is translatable with respect to base frame 24 as each main hydraulic cylinder extends or retracts. Moreover, as shown in FIGS. 2 and 5 for example, the ends of the outer cross-risers' side rails 82 pivotably connected to reverse Trendelenburg linkage 102 are translatable with respect to intermediate frame 52 as each main hydraulic cylinder 120 expands or retracts. Furthermore, as the extension or retraction of each piston rod 124 of each main hydraulic cylinder 120 causes translation of one of the respective ends of each of the cross-risers, intermediate frame 52 moves vertically either towards or away from base frame 24. Moreover, during this vertical movement, intermediate frame 52 maintains a level orientation as reverse Trendelenburg linkage 102 pivots on cam follower 118 and Trendelenburg linkage 86 pivots about the free ends of Trendelenburg cross bar 92, which is pivotably connected to intermediate frame 52.

In an embodiment of the present invention designed for a system such as HARGEST et al, each of the main hydraulic cylinders 120 is capable of operating at working pressures of up to 1250 psi. Moreover, each such main hydraulic cylinder desirably is provided with a two inch diameter casing bore and a six and one half inch maximum stroke. Furthermore, each main hydraulic cylinder 120 is desirably a dual acting hydraulic cylinder, and thus has hydraulic fluid on both sides of the piston. However, only the hydraulic fluid on one side of the piston is connected to a pressurized hydraulic fluid source. For example, in the embodiment shown in FIGS. 5 and 8 for example, the blind side of the piston is pressurized to raise the intermediate frame, and the force of gravity lowers same. Thus, FIGS. 5 and 8 illustrate a pull configuration of the disposition of main hydraulic cylinders 120. In the FIG. 5 and 8 configuration, extension of piston rods 124 of main hydraulic cylinders 120 results in an increase in the vertical distance between intermediate frame 52 and base frame 24.

Conversely, in the embodiment shown in FIGS. 1-4, the rod side of the piston is pressurized to raise the intermediate frame, and the force of gravity lowers same. As shown in FIGS. 1-4, main hydraulic cylinders 120 are disposed in a push configuration such that extension of piston rods 124 results in lowering of intermediate frame 52 closer to base frame 24. The particular configuration (push or pull) chosen for the apparatus of the present invention is dictated by space limitations and other design criteria of the patient support system served by the apparatus of the present invention.

In still further accordance with the apparatus of the present invention, means are provided for pivoting the Trendelenburg linkage about each respective heel-connecting portion. As embodied herein and shown in FIGS. 1-5 and 8 for example, the means for pivoting the Trendelenburg linkage about its respective heel-connecting portions can include at least one Trendelenburg hydraulic cylinder 126. Desirably, a pair of Trendelenburg hydraulic cylinders 126 are provided. Each Trendelenburg hydraulic cylinder defines a cylinder casing member, a piston disposed within and hydraulically connected to each cylinder casing, and a piston rod 128 having one end connected to the piston within the cylinder casing and an opposite free end extending outside the casing. Each Trendelenburg hydraulic cylinder has a first end pivotally connected to inner cross-riser 64. As shown in FIGS. 2-5 and for example, the end of each Trendelenburg hydraulic cylinder casing is pivotally connected to mounting bracket plate 76 of inner cross-riser 64. Each Trendelenburg hydraulic cylinder has a second end disposed opposite each Trendelenburg hydraulic cylinder first end. As shown in FIGS. 2 and 5 for example, the free end of each Trendelenburg hydraulic cylinder piston rod 128 is pivotally connected to a respective Trendelenburg linkage toe-connecting portion 94.

In an embodiment of the present invention designed for a system such as HARGEST et al, each Trendelenburg hydraulic cylinder is a hydraulic cylinder having a one and one-half inch diameter bore, a two and one eighth inch maximum stroke, and operates at a working pressure of up to 1,250 psi. Moreover, each Trendelenburg hydraulic cylinder is a single action hydraulic cylinder such that hydraulic fluid is only provided to one side of the piston of each Trendelenburg hydraulic cylinder, which desirably is provided with a spring-loaded return to ensure that the piston rod retracts after the hydraulic cylinder is no longer pressurized.

In still further accordance with the apparatus of the present invention, means are provided for pivoting the reverse Trendelenburg linkage about each respective heel-connecting portion. As embodied herein and shown in FIGS. 1-5 and 8 for example, the means for pivoting the reverse Trendelenburg linkage about its respective heel-connecting portions can include at least one reverse Trendelenburg hydraulic cylinder 130. Desirably, a pair of reverse Trendelenburg hydraulic cylinders 130 are provided. Each reverse Trendelenburg hydraulic cylinder 130 defines a cylinder casing member, a piston disposed within and hydraulically connected to each cylinder casing, and a piston rod 132 having one end connected to the piston within the cylinder casing and an opposite free end extending outside the casing. Each reverse Trendelenburg hydraulic cylinder has a first end pivotally connected to outer cross-riser 80. As shown in FIGS. 2-5 and 8 for example, the end of each reverse Trendelenburg hydraulic cylinder casing is pivotally connected to a mounting bracket 134 attached to a side rail 82 of outer cross-riser 80. Each reverse Trendelenburg hydraulic cylinder has a second end disposed opposite each reverse Trendelenburg hydraulic cylinder first end. As shown in FIGS. 2 and 5 for example, the free end of each reverse Trendelenburg hydraulic cylinder piston rod is pivotally connected to a respective reverse Trendelenburg linkage toe-connecting portion 110.

In an embodiment of the present invention designed for a system such as HARGEST et al, each reverse Trendelenburg hydraulic cylinder is a single action hydraulic cylinder having a one and one-half inch diameter bore, a two and three eighths inch maximum stroke, and operates at a working pressure of up to 1,250 psi.

Figure 7:
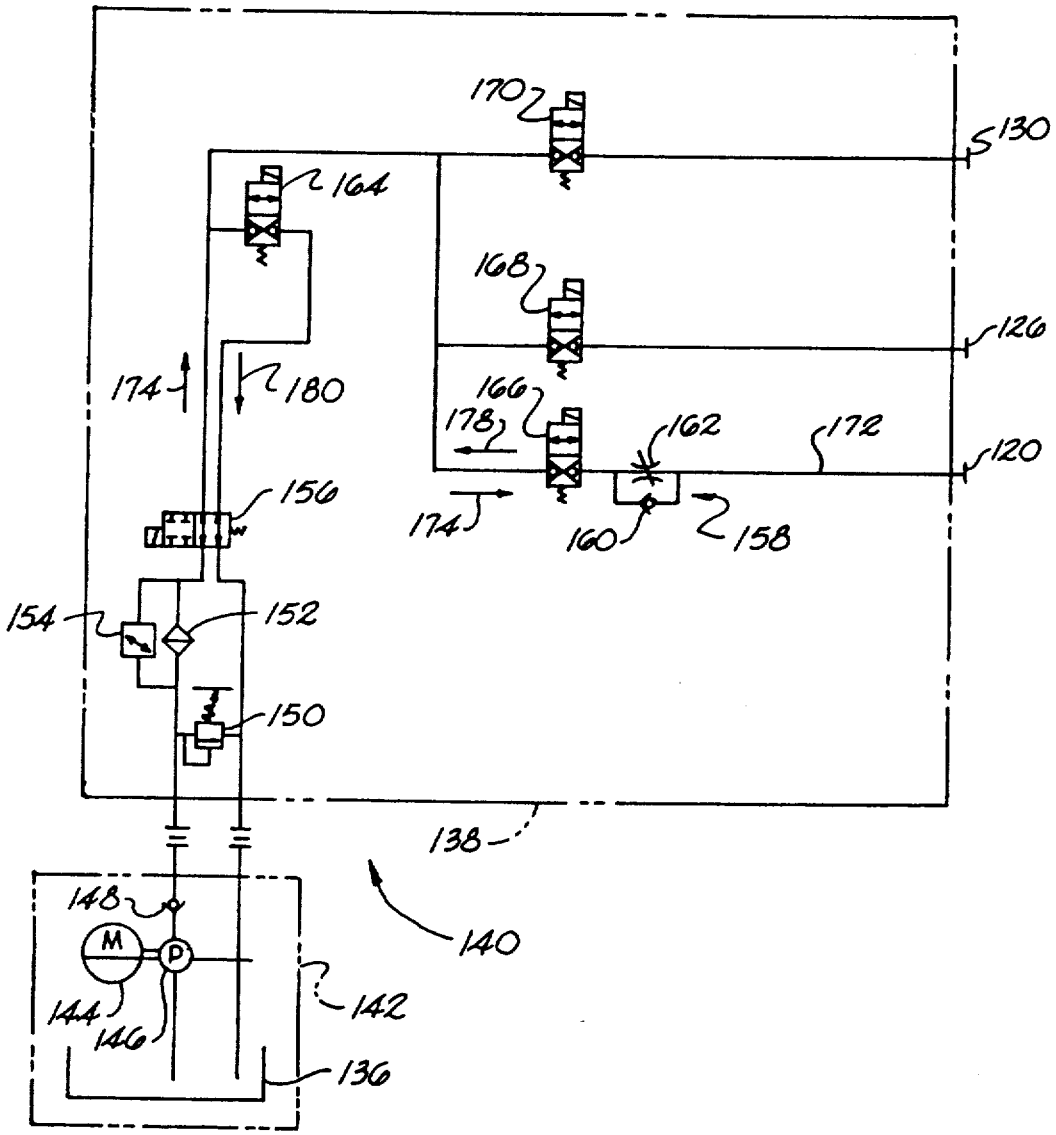
FIG. 7 illustrates a schematic representation of hydraulic circuitry components of a preferred embodiment of the present invention.

As shown in FIGS. 1, 2 and 7 for example, the hydraulic system for powering the main hydraulic cylinders, the Trendelenburg cylinders, and the reverse Trendelenburg cylinders includes a hydraulic reservoir 136 containing hydraulic fluid at atmospheric pressure. As shown in FIGS. 1, 2 and 7 for example, a hydraulic manifold 138 is provided to regulate the flow of hydraulic fluid to each of the main hydraulic cylinders 120, Trendelenburg hydraulic cylinders 126, and reverse Trendelenburg hydraulic cylinders 130. As shown in FIG. 7 for example, a desired embodiment of an hydraulic circuit 140 suitable for a HARGEST et al system is schematically illustrated showing the path of hydraulic fluid between the hydraulic fluid reservoir and each of the hydraulic cylinders. The valves controlling the flow of the hydraulic fluid also are schematically illustrated in FIG. 7.

As embodied herein and shown schematically in FIG. 7 for a HARGEST et al system for example, the hydraulic system includes a power unit 142 and a main hydraulic circuit encompassed within manifold 138. Referring to the power unit, and as shown in FIGS. 1 and 7 for example, an electric motor 144 is connected to operate a hydraulic fluid pump 146, which is supplied with hydraulic fluid from a hydraulic fluid reservoir 136 containing about 0.2 gallons of hydraulic fluid. A suitable electric motor is a one third horsepower, 60 Hz, 120 volts, A/C, permanent split capacitor style motor, which is a capacitor start/capacitor run style motor. A 50 to 60 Hz, 115 volt A/C cap start/induction run motor also could be used. A suitable hydraulic fluid pump is a positive displacement, single direction rotation pump having a maximum rated pumping capacity of about 0.33 gallons of hydraulic fluid per minute at a working pressure of about 1250 psi. The output line of pump 146 passes through a first check valve 148 that prevents backward flow into pump 146. In an embodiment such as shown in FIGS. 5 and 8 for example, hydraulic reservoir 136, hydraulic manifold 138 and power unit 142 can be carried on a platform 190 carried by the base frame.

As shown in FIG. 7 for a HARGEST et al system for example, the main hydraulic circuit includes a sun pressure relief valve 150, a filter 152, a filter indicator 154, a safety valve 156, four bi-directional poppet valves, and a pressure compensated flow control valve 158.

The apparatus of the present invention is designed so that it can be used with a fluidizable support system. The particulate matter used in such a system should be prevented from becoming lodged in the various hydraulic components such as the valves identified above. The diameters of the fluidizable particulate matter are on the order of 50 microns, and filter 152 removes particulate matter larger than 20 microns. Moreover, filter indicator 154 produces a signal when a pressure differential of about 300 psi exists between one side of filter 152 and the opposite side of filter 152. At this pressure differential, sufficient clogging of filter 152 has occurred so that filter 152 should be replaced with a new filter, and the particulate matter lodged on filter 152 should be removed with the clogged filter.

Sun relief valve 150 has a "breakdown" pressure threshold that must be met before relief valve 150 becomes activated to permit flow (from the pump to the reservoir in the configuration schematically shown in FIG. 7). The breakdown threshold of relief valve 150 is variable and can be set mechanically. In the configuration of the main hydraulic circuit, sun relief valve 150 is set at the maximum pressure deemed necessary to power main hydraulic cylinders 120 to raise or lower intermediate frame 52, assuming that the intermediate frame carries the support surface of the patient support system carrying the patient of maximum anticipated weight. With the two inch bore hydraulic cylinders 120 described above, the preset pressure for first relief valve 150 typically can be set at about 1250 psi.

Each of the four bi-directional poppet valves is normally closed and capable of remaining completely closed at working pressures up to 3,000 psi. As shown schematically in FIG. 7 for example, a first bi-directional poppet valve 164 is disposed in the main hydraulic circuit so as to be able to act as a directional control valve. A second bi-directional poppet valve 166 is disposed in the main hydraulic circuit so as to be able control actuation of main hydraulic cylinders 120. A third bi-directional poppet valve 168 is disposed in the main hydraulic circuit so as to be able control actuation of Trendelenburg hydraulic cylinders 126. A fourth bi-directional poppet valve 170 is disposed in the main hydraulic circuit so as to be able control actuation of reverse Trendelenburg hydraulic cylinders 130.

As shown schematically in FIG. 7, pressure compensated flow control valve 158 has a check valve 160 in one branch and a pressure compensated variable flow control 162 in a second branch. The check valve branch prevents flow in one direction and provides almost no resistance to flow in the opposite direction. The pressure compensated variable flow branch restricts the flow through it to a preset rate of flow, regardless of the pressure of the fluid entering this branch. The flow setting of the pressure compensated flow control valve 158 is variable and can be set mechanically. With the two inch bore hydraulic cylinders 120 described above, the flow setting of pressure compensated flow control valve 158 typically can be set at about 0.43 gallons per minute (0.552 cubic feet per minute), allowing for about 5% more or less flow.

Reference now will be made to the schematic illustration of FIG. 7 in describing the expansion (extending piston rod 124 out of the cylinder casing member) and then the contraction (withdrawing piston rod 124 into the cylinder casing member) of the dual acting hydraulic cylinders. Each of the four bi-directional valves 164, 166, 168, 170 and the safety valve 156 are spring return, solenoid valves. The pump motor 144 and each of the solenoid valves can be electrically activated. Desirably, the electrical activation of each of the solenoid valves and the pump motor is controlled by a microprocessor unit, which has been preprogrammed for raising, lowering, stopping, and inclining (Trendelenburg or Reverse Trendelenburg) the level of intermediate frame 52. Moreover, it also is desirable to provide sensing apparatus to determine when intermediate frame 52 is disposed in either a Trendelenburg orientation (shown schematically in FIG. 3 for example) or reverse Trendelenburg orientation (shown schematically in FIG. 4 for example). The sensing apparatus can transmit this information for processing by the microprocessor. Whenever it is desired to raise or lower intermediate frame 52, the microprocessor uses the information provided by the sensing apparatus to check the orientation of intermediate frame 52. The microprocessor can be preprogrammed to delay raising or lowering the intermediate frame via actuation of the main hydraulic cylinders until such time as the intermediate frame has been returned to a level condition.

Pump 146 is normally inactivated and becomes activated (pursuant to a signal from the microprocessor activating pump motor 144 for example) when one of the hydraulic features of the apparatus is to be operated. Assuming that main hydraulic cylinders 120 are to be actuated to raise the patient support surface attached to intermediate frame 52, pump 146 is activated and will supply hydraulic fluid through a first hydraulic conduit line 172 at a pressure of up to the threshold pressure set for sun relief valve 150. If the pressure in the hydraulic system exceeds the preset pressure (such as 1250 psi for example) of sun relief valve 150, sun relief valve 150 triggers and returns hydraulic fluid to reservoir 136. However, so long as the pressure in the hydraulic system does not exceed the preset breakdown pressure threshold of the sun relief valve, hydraulic fluid proceeds past sun relief valve 150 and flows through filter 152. Hydraulic fluid then passes through safety valve 156, which is normally in the open position. Since the main cylinders are to be activated, main cylinder bi-directional poppet valve 166 is activated and permits hydraulic fluid to flow in the direction of activation arrow 174 (FIG. 7), which direction leads the hydraulic fluid to flow backward through the check valve branch of pressure compensated flow control valve 158 and then to exit the main circuit port leading to main hydraulic cylinders 120.

Main hydraulic cylinders 120 desirably are double acting cylinders rather than single acting cylinders. With a single acting cylinder, there is no hydraulic fluid at the front end (where the piston rod exits the cylinder casing) of the cylinder to provide a damping force against the initial surge of the piston when the blind end of the cylinder is being supplied with hydraulic fluid by the activated pump. However, in the double acting cylinder desirably used for the main cylinders in the apparatus of the present invention, a restriction orifice is formed in the front end of the cylinder and meters out hydraulic fluid from the cylinder when the blind end of the cylinder is supplied with fluid by the pump. Conversely, the orifice permits inflow of hydraulic fluid from the reservoir when the blind end of the cylinder is no longer being supplied with fluid by the pump and instead is allowed to drain through pressure compensated flow control branch 162 of valve 158.

Moreover, in an alternative embodiment of the main hydraulic circuit, a sharp edge orifice plate can be disposed in the hydraulic fluid conduit line leading from the main hydraulic circuit to each of the Trendelenburg cylinders and the reverse Trendelenburg cylinders. Each such orifice plate acts as a flow restrictor and provides a fluid flow damping mechanism to guard against sudden surges of the hydraulic cylinders when they are first connected to the pump by actuation of the appropriate bi-directional poppet valve.

When it is desired to lower the intermediate frame 52 and withdraw the pistons rods 124 of the main cylinders 120 into their respective casings, pump 146 is turned off, main cylinder bi-directional poppet valve 166 remains in the open position, and directional flow control valve 164 is opened. The weight of the patient support apparatus carried by intermediate frame 52 forces fluid from main cylinders 120 in the direction of arrow 178 via pressure compensated branch 162 of pressure compensated flow control valve 158. Pressure compensated variable flow branch 162 restricts the flow of hydraulic fluid in the direction of arrow 178 to the preset rate of flow. At this preset rate of hydraulic fluid flow, the intermediate frame will be lowered at a speed well within the tolerance level of a patient supported in the pateint support apparatus. Moreover, since check valve 148 prevents reverse flow into pump 146, the path of least resistance forces hydraulic fluid to flow through directional flow control valve 164 in the direction of arrow 180 and thence into reservoir 136.

Operation of the Trendelenburg cylinders or the reverse Trendelenburg cylinders proceeds in a fashion identical to that described for operating the main cylinders, with the exception of the particular bi-directional poppet valve that is activated and the flow through pressure compensated flow control valve 158. For example, operation of the Trendelenburg cylinders 126 requires that only the Trendelenburg bi-directional poppet valve 168 be activated so as to permit hydraulic fluid to flow from pump 146 to Trendelenburg cylinders 126. The other bi-directional poppet valves are configured to prevent hydraulic to flow from pump 146 to either reverse Trendelenburg cylinders 130 or main cylinders 120.

In an alternative embodiment of the apparatus of the present invention, the various hydraulic cylinders and hydraulic circuit components could be replaced by various electric motors and electro-mechanical devices or pneumatic cylinders and pneumatic circuit components. In yet another alternative embodiment of the apparatus of the present invention, the Trendelenburg linkage could be carried by the outer cross-riser and the reverse Trendelenburg linkage could be carried by the inner cross-riser.

What is claimed is:

1. An apparatus for performing Trendelenburg Therapy and Reverse Trendelenburg Therapy in a patient support system which supports at least a portion of the patient's body in an air fluidized mass of material, the apparatus comprising:

(a) a base frame;

(b) an intermediate frame;

i) said intermediate frame for carrying the fluidized mass of material, (c) an inner cross-riser, i) said inner cross-riser defining a first end, ii) said inner cross-riser defining a second end disposed opposite said first end, and iii) said first end of said inner cross-riser being translatably and rotatably connected to said base frame;

(d) a first Trendelenburg linkage, i) said first Trendelenburg linkage defining a toe connecting portion, a heel connecting portion, and a calf connecting portion, ii) said first Trendelenburg linkage heel connecting portion being pivotally connected to said second end of said inner cross-riser;

(e) an outer cross-riser, i) said outer cross-riser defining a first end, ii) said outer cross-riser defining a second end disposed opposite said first end, and iii) said first end of said outer cross-riser being pivotally connected to said base frame; and (h) a first Reverse Trendelenburg linkage having a toe connecting portion, a heel connecting portion, and a calf connecting portion, i) said first Reverse Trendelenburg linkage heel connecting portion being pivotally connected to said second end of said outer cross-riser.

2. An apparatus as in claim 1, further comprising:

(i) a tank for carrying a mass of fluidizable material, i) said tank being carried by said intermediate frame.

3. An apparatus as in claim 1, further comprising:

(i) means for translating one of said cross-risers with respect to one of said frames and the other of said cross-risers with respect to said other of said frames.

4. An apparatus as in claim 3, wherein: said outer cross-riser and said inner cross-riser are pivotally connected to one another between said first and second ends of said respective outer and inner cross-risers.

5. An apparatus as in claim 4, wherein said means for translating one of said cross-risers with respect to one of said frames and the other of said cross-risers with respect to said other of said frames includes:

i) at least one main hydraulic cylinder, ii) each said main hydraulic cylinder having a first end connected to one of said frames.

6. An apparatus as in claim 5, wherein:

i) each said main hydraulic cylinder having a first end connected to said base frame, and ii) each said main hydraulic cylinder having a second end disposed opposite said main hydraulic cylinder first end and being pivotally connected to said first end of said inner cross-riser.

7. An apparatus as in claim 6, wherein: said first end of said inner cross-riser is translatable with respect to said base frame as each said main hydraulic cylinder extends or retracts.

8. An apparatus as in claim 7, further comprising:

(j) a cam follower defined on said first end of said inner cross-riser; and (k) a cam configured for receiving said cam follower, i) said cam being disposed along said base frame.

9. An apparatus as in claim 5, wherein:

i) said second end of said outer cross-riser is translatably and rotatably connected to said intermediate frame, and ii) said second end of said outer cross-riser is configured and disposed so as to be translatable with respect to said intermediate frame as each said main hydraulic cylinder extends or retracts.

10. An apparatus as in claim 9, further comprising:

(j) a cam follower defined on said second end of said outer cross-riser; and (k) a cam configured for receiving said cam follower, i) said cam being disposed along said intermediate frame.

11. An apparatus as in claim 1, further comprising:

(i) means for pivoting said first Trendelenburg linkage about said respective heel connecting site.

12. An apparatus as in claim 11, wherein said means for pivoting said first Trendelenburg linkage about said respective heel connecting site includes:

i) at least one Trendelenburg hydraulic cylinder, ii) each said Trendelenburg hydraulic cylinder having a first end pivotally connected to said inner cross-riser, iii) each said Trendelenburg hydraulic cylinder having a second end disposed opposite said Trendelenburg hydraulic cylinder first end and being pivotally connected to said respective Trendelenburg linkage toe connecting portion.

13. An apparatus as in claim 1, further comprising:

(i) means for pivoting said first Reverse Trendelenburg linkage about said respective heel connecting site.

14. An apparatus as in claim 13, wherein said means for pivoting said first Reverse Trendelenburg linkage about said respective heel connecting site includes:

i) at least one Reverse Trendelenburg hydraulic cylinder, ii) each said Reverse Trendelenburg hydraulic cylinder having a first end pivotally connected to said outer cross-riser, iii) each said Trendelenburg hydraulic cylinder having a second end disposed opposite said Reverse Trendelenburg hydraulic cylinder first end and being pivotally connected to said respective Reverse Trendelenburg linkage toe connecting portion.

15. An apparatus as in claim 1, wherein:

i) an imaginary straight line drawn to connect said first Trendelenburg linkage toe connecting portion and said first Trendelenburg linkage heel connecting portion is disposed at an angle from where an imaginary straight line drawn to connect said first Trendelenburg linkage calf connecting portion and said first Trendelenburg linkage heel connecting portion is disposed.

16. An apparatus as in claim 15, wherein:

i) an imaginary straight line drawn to connect said Reverse Trendelenburg linkage toe connecting portion and said Reverse Trendelenburg linkage heel connecting portion is disposed at an angle from where an imaginary straight line drawn to connect said Reverse Trendelenburg linkage calf connecting portion and said Reverse Trendelenburg linkage heel connecting portion is disposed.

17. An apparatus for performing Trendelenburg Therapy and Reverse Trendelenburg Therapy in a patient support system which supports at least a portion of the patient's body in an air fluidized mass of material, the apparatus comprising:

(a) a base frame;

(b) means for carrying said fluidizable mass of material;

(c) an intermediate frame for carrying said carrying means;

(d) an inner cross-riser having one end pivotally connected to said intermediate frame;

(e) an outer cross-riser, i) said outer cross-riser defining a first elongated outer riser member, ii) said first outer riser member having a first end and a second end disposed opposite said first end, iii) said first outer riser member being disposed on a first side of said inner cross-riser and having said first end pivotally mounted to said base frame, iv) said outer cross-riser defining a second elongated outer riser member disposed parallel to said first outer riser member, v) said second outer riser member having a first end and a second end disposed opposite said first end, and vi) said second outer riser member being disposed on a second side of said inner cross-riser and having said first end pivotally mounted to said base frame, and vii) said outer cross-riser defining at least one cross-piece member extending between and connecting said first outer riser member and said second outer riser member;

(f) a first Trendelenburg linkage having a toe connecting site, a heel connecting site, and a calf connecting site, i) said calf connecting site being pivotally connected to a second end of said intermediate frame, and ii) said heel connecting site being pivotally connected to said second end of said inner cross-riser;

(g) a first Reverse Trendelenburg linkage having a toe connecting site, a heel connecting site, and a calf connecting site, i) said calf connecting site of said first Reverse Trendelenburg linkage being translatably and rotatably connected to said second end of said intermediate frame, ii) said heel connecting site of said first Reverse Trendelenburg linkage being pivotally connected to said second end of said first outer riser member; and (h) means for pivoting both said Trendelenburg and Reverse Trendelenburg linkages about said respective heel connecting sites.

18. An apparatus as in claim 17, further comprising:

(h) a second Trendelenburg linkage having a toe connecting site, a heel connecting site, and a calf connecting site, i) said calf connecting site of said second Trendelenburg linkage being pivotally connected to said second end of said intermediate frame, ii) said heel connecting site of said second Trendelenburg linkage being pivotally connected to said second end of said inner cross-riser;

(i) a second Reverse Trendelenburg linkage having a toe connecting site, a heel connecting site, and an ankle connecting site, i) said calf connecting site of said second Reverse Trendelenburg linkage being translatably and rotatably connected to said second end of said intermediate frame, ii) said heel site of said second Reverse Trendelenburg linkage being pivotally connected to said second end of said second outer riser member; and (j) means for pivoting both said second Trendelenburg and second Reverse Trendelenburg linkages about said respective heel connecting sites.

19. An apparatus as in claim 17, wherein: said outer cross-riser and said inner cross-riser are pivotally connected to one another between said first and second ends of said respective outer and inner cross-risers.

20. An apparatus for performing Trendelenburg Therapy and Reverse Trendelenburg Therapy in a patient support system which supports at least a portion of the patient's body in an air fluidized mass of material, the apparatus comprising:

(a) a base frame;

(b) an intermediate frame;

i) said intermediate frame for carrying the fluidized mass of material, (c) a inner cross-riser, i) said inner cross-riser defining a first end, ii) said inner cross-riser defining a second end disposed opposite said first end;

(d) at least one main hydraulic cylinder, i) each said main hydraulic cylinder having a first end connected to said base frame, ii) each said main hydraulic cylinder having a second end disposed opposite said main hydraulic cylinder first end and being pivotally connected to said first end of said inner cross-riser;

(e) at least a first Trendelenburg linkage, i) each said Trendelenburg linkage defining a member having an L-shaped configuration, ii) each said Trendelenburg linkage defining a toe connecting portion in the vicinity of the free end of the shorter leg of said L-shaped configuration, iii) each said Trendelenburg linkage defining a calf connecting portion in the vicinity of the free end of the longer leg of said L-shaped configuration, iv) each said Trendelenburg linkage defining a heel connecting portion in the vicinity of where the shorter leg joins with the longer leg of said L-shaped configuration, v) each said Trendelenburg linkage calf connecting portion being pivotally connected to said intermediate frame, and vi) each said Trendelenburg linkage heel connecting portion being pivotally connected to said second end of said inner cross-riser;

(f) at least one Trendelenburg hydraulic cylinder, i) each said Trendelenburg hydraulic cylinder having a first end pivotally connected to said inner cross-riser, ii) each said Trendelenburg hydraulic cylinder having a second end disposed opposite said Trendelenburg hydraulic cylinder first end and being pivotally connected to said first Trendelenburg linkage toe connecting portion;

(g) an outer cross-riser, i) said outer cross-riser defining a first end, ii) said outer cross-riser defining a second end disposed opposite said first end, and iii) said first end of said outer cross-riser being pivotally connected to said base frame;

(h) a Reverse Trendelenburg linkage, i) said Reverse Trendelenburg linkage defining a member having an L-shaped configuration, ii) said Reverse Trendelenburg linkage defining a toe connecting portion in the vicinity of the free end of the shorter leg of said L-shaped configuration, iii) said Reverse Trendelenburg linkage defining a calf connecting portion in the vicinity of the free end of the longer leg of said L-shaped configuration, iv) said Reverse Trendelenburg linkage defining a heel connecting portion in the vicinity of where the shorter leg joins with the longer leg of said L-shaped configuration, v) said Reverse Trendelenburg linkage heel connecting portion being pivotally connected to said second end of said outer cross-riser, vi) said Reverse Trendelenburg linkage calf connecting portion being translatably and rotatably connected to said intermediate frame; and (i) at least one Reverse Trendelenburg hydraulic cylinder, i) each said Reverse Trendelenburg hydraulic cylinder having a first end pivotally connected to said outer cross-riser, and ii) each said Reverse Trendelenburg hydraulic cylinder having a second end disposed opposite said Reverse Trendelenburg hydraulic cylinder first end and being pivotally connected to said Reverse Trendelenburg linkage toe connecting portion.

* * * * *